US010174396B2

(12) United States Patent
Takashima et al.

(10) Patent No.: US 10,174,396 B2
(45) Date of Patent: Jan. 8, 2019

(54) HIGH-STRENGTH COLD-ROLLED STEEL SHEET AND METHOD FOR MANUFACTURING THE SAME (AS AMENDED)

(71) Applicant: JFE STEEL CORPORATION, Tokyo (JP)

(72) Inventors: Katsutoshi Takashima, Chiba (JP); Yuki Toji, Chiba (JP); Kohei Hasegawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 184 days.

(21) Appl. No.: 15/115,138

(22) PCT Filed: Jan. 21, 2015

(86) PCT No.: PCT/JP2015/000241
§ 371 (c)(1),
(2) Date: Jul. 28, 2016

(87) PCT Pub. No.: WO2015/115059
PCT Pub. Date: Aug. 6, 2015

(65) Prior Publication Data

US 2016/0369369 A1 Dec. 22, 2016

(30) Foreign Application Priority Data

Jan. 29, 2014 (JP) ..... 2014-014197

(51) Int. Cl.

| | |
|---|---|
| ***C21D 1/20*** | (2006.01) |
| ***C21D 1/22*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/28*** | (2006.01) |
| ***C22C 38/32*** | (2006.01) |

(Continued)

(52) U.S. Cl.

CPC ..... *C21D 9/46* (2013.01); *C21D 1/20* (2013.01); *C21D 1/22* (2013.01); *C21D 8/0221* (2013.01); *C21D 8/0226* (2013.01); *C21D 8/0236* (2013.01); *C21D 8/0247* (2013.01); *C21D 8/0263* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/28* (2013.01); *C22C 38/32* (2013.01); *C22C 38/38* (2013.01); *C22C 38/58* (2013.01); *C21D 2211/001* (2013.01); *C21D 2211/002* (2013.01); *C21D 2211/003* (2013.01); *C21D 2211/005* (2013.01); *C21D 2211/008* (2013.01)

(58) Field of Classification Search

CPC .. C21D 9/46; C21D 8/0236; C21D 2211/001; C21D 2211/002; C21D 2211/003; C21D 2211/005; C21D 2211/008; C22C 38/001; C22C 38/0002; C22C 38/005; C22C 38/02–38/08; C22C 38/14–38/22; C22C 38/32; C22C 38/34; C22C 38/38–38/44; C22C 38/50; C22C 38/54; C22C 38/58

See application file for complete search history.

(56) References Cited

U.S. PATENT DOCUMENTS

| | | | | |
|---|---|---|---|---|
| 8,951,366 | B2 * | 2/2015 | Sano | C21D 8/0436 148/320 |
| 2011/0198002 | A1 | 8/2011 | Nakagaito et al. | |
| 2012/0132327 | A1 | 5/2012 | Mukai et al. | |

(Continued)

FOREIGN PATENT DOCUMENTS

| | | |
|---|---|---|
| EP | 2530179 A | 5/2012 |
| EP | 2604715 A1 | 6/2013 |

(Continued)

OTHER PUBLICATIONS

International Search Report and Written Opinion for International Application No. PCT/JP2015/000241, dated Apr. 21, 2015, 4 pages.

(Continued)

*Primary Examiner* — C Melissa Koslow
(74) *Attorney, Agent, or Firm* — RatnerPrestia

(57) ABSTRACT

A high-strength cold-rolled steel sheet has a chemical composition containing, by mass %, C: 0.15% or more and 0.30% or less, Si: 0.8% or more and 2.4% or less, Mn: 2.4% or more and 3.5% or less, P: 0.08% or less, S: 0.005% or less, Al: 0.01% or more and 0.08% or less, N: 0.010% or less, Ti: 0.002% or more and 0.05% or less, B: 0.0002% or more and 0.0050% or less, and the balance being Fe and inevitable impurities, a microstructure including ferrite having an average grain diameter of 3 μm or less and a volume fraction of 5% or less (including 0%), retained austenite having a volume fraction of 10% or more and 20% or less, martensite having an average grain diameter of 4 atm or less and a volume fraction of 20% or less (including 0%), and the balance including bainite and/or tempered martensite.

4 Claims, No Drawings

(51) Int. Cl.
*C22C 38/38* (2006.01)
*C22C 38/58* (2006.01)

(56) References Cited

U.S. PATENT DOCUMENTS

| | | | |
|---|---|---|---|
| 2015/0086808 | A1 | 3/2015 | Kasuya et al. |
| 2015/0101712 | A1 | 4/2015 | Futamura et al. |

FOREIGN PATENT DOCUMENTS

| | | | | |
|---|---|---|---|---|
| JP | 2005240178 | | | 9/2005 |
| JP | 2011052295 | | | 3/2011 |
| JP | 2013060657 | | | 4/2013 |
| JP | 2013072101 | | | 4/2013 |
| JP | 2013227653 | A | | 11/2013 |
| JP | 2013227654 | A | | 11/2013 |
| KR | 20130036763 | A | | 4/2013 |
| WO | WO 2011/093319 | | * | 8/2011 |

OTHER PUBLICATIONS

Chinese Office Action with partial English language translation for Application No. 201580006501.3, dated Mar. 13, 2017, 10 pages.
Korean Office Action with Concise Statement of Relevance for Korean Application No. 10-2016-7023517, dated Jan. 18, 2018, 5 pages.
Japanese Office Action with partial English language translation for Application No. 2015-559808, dated Dec. 21, 2016, 4 pages.
English language Supplementary European Search Report for Application No. EP 15743100.8, dated Jan. 31, 2017, 6 pages.
Warm Formability of Ultra High-Strength Low Alloy Trip-Aided Sheet Steels With Bainitic Ferrite Matrix, with partial translation, Koh-ichi Sugimoto et al., Tetsu To Hagane: Journal of The Iron and Steel Institute of Japan, Iron and Steel, vol. 91, No. 2, Feb. 1, 2005, pp. 278-284, 7 pages.
Korean Notice of Allowance for Korean Application. No. 10-2016-7023517, dated Jul. 23, 2018—2 pages.

* cited by examiner

HIGH-STRENGTH COLD-ROLLED STEEL SHEET AND METHOD FOR MANUFACTURING THE SAME (AS AMENDED)

CROSS-REFERENCE TO RELATED APPLICATIONS

This is the U.S. National Phase application of PCT International Application No. PCT/JP2015/000241, filed Jan. 21, 2015, and claims priority to Japanese Patent Application No. 2014-014197, filed Jan. 29, 2014, the disclosures of each of these applications being incorporated herein by reference in their entireties for all purposes.

FIELD OF THE INVENTION

The present invention relates to a high-strength cold-rolled steel sheet with a high yield ratio and a method for manufacturing the steel sheet, and in particular, to a high-strength cold-rolled steel sheet which can preferably be used as a member for structural parts of, for example, an automobile.

BACKGROUND OF THE INVENTION

Nowadays, since $CO_2$ emission regulations are being strengthened in response to mounting environmental problems, weight reduction of an automobile body for increasing fuel efficiency is a target to be achieved in the automobile industry. Therefore, there is a growing trend toward using a high-strength steel sheet for automobile parts in order to decrease the thickness of steel sheets, in particular, there is a growing trend toward using a high-strength cold-rolled steel sheet having a tensile strength (TS) of 1180 MPa or more.

A high-strength steel sheet which is used for the structural members and reinforcing members of an automobile is required to have excellent formability. In particular, a high-strength steel sheet which is used for parts having a complex shape is required to be excellent not only in terms of single property such as elongation or stretch flange formability (also referred to as hole expansion formability), but in terms of both elongation and stretch flange formability. Moreover, automobile parts such as structural members and reinforcing members are required to be excellent in terms of impact energy absorbing property. Increasing the yield ratio of a steel sheet, which is a material for automobile parts, is effective for increasing the impact energy absorbing property of the automobile parts. Automobile parts which are manufactured by using a steel sheet with a high yield ratio are capable of efficiently absorbing impact energy with a small amount of deformation. Here, "yield ratio" (YR) refers to the ratio of yield stress (YS) to tensile strength (TS) and is expressed as YR=YS/TS.

Conventionally known examples of a high-strength thin steel sheet having both high strength and satisfactory formability include dual phase steel (DP steel) having a ferrite-martensite structure (Patent Literature 1). The DP steel, which is multi-phase steel having a microstructure including ferrite as a main phase in which martensite is dispersed, has a low yield ratio, high TS, and excellent elongation.

In addition, known examples of a steel sheet having both high strength and excellent ductility include a TRIP steel sheet, which is manufactured by utilizing the transformation induced plasticity of retained austenite (Patent Literature 2). Since this TRIP steel sheet has a steel sheet microstructure including retained austenite, when the TRIP steel sheet is subjected to deformation by performing processing at a temperature equal to or higher than the martensite transformation start temperature, a large elongation is achieved as a result of retained austenite undergoing induced transformation into martensite by stress.

CITATION LIST

Patent Literature

PTL 1: Japanese Unexamined Patent Application Publication No 2011-052295

PTL 2: Japanese Unexamined Patent Application Publication No. 2005-240178

SUMMARY OF THE INVENTION

However, generally, in the case of DP steel, since there is a decrease in yield ratio because movable dislocations are introduced in ferrite when martensite transformation occurs, there is a decrease in impact energy absorbing property. In addition, the steel sheet, which is manufactured by utilizing retained austenite, is not a steel sheet having increased elongation and stretch flange formability while achieving a high strength in a strength range of 1180 MPa or more.

As described above, in the case of a high-strength steel sheet having strength of 1180 MPa or more, it is difficult to achieve elongation and stretch flange formability corresponding to excellent press formability while maintaining excellent impact energy absorbing property. In addition, it is a fact that a steel sheet excellent in terms of all the properties described above (yield ratio, strength, elongation, and stretch flange formability) has not been developed.

Aspects of the present invention have been completed in view of the situation described above. An object of aspects of the present invention is, by solving the problems with the conventional techniques described above, to provide a high-strength cold-rolled steel sheet with a high yield ratio excellent in terms of elongation and stretch flange formability and a method for manufacturing the steel sheet.

Solution to Problem

The present inventors diligently conducted investigations, and, as a result, found that, by controlling the volume fractions of ferrite, retained austenite, and martensite in the steel sheet microstructure to be within specified ranges, by controlling the average grain diameters of ferrite and martensite, and by controlling the distribution of precipitated cementite grains, it is possible to achieve a good elongation property and excellent stretch flange formability while achieving a high yield ratio. Aspects of the present invention have been completed on the basis of the findings.

First, the present inventors, from the results of investigations regarding the relationship between a steel sheet microstructure and the above-described properties such as tensile strength, yield ratio, elongation, and stretch flange formability, considered the following.

a) In the case where martensite or retained austenite having a high hardness exists in a steel sheet microstructure, voids are formed at the interface between ferrite and martensite or retained austenite, in particular, at the interface with the soft ferrite during a punching process of a hole expanding test, and the voids combine with each other and grow in a subsequent hole expanding process, which results in cracking. Therefore, it is difficult to achieve good stretch flange formability. On the other hand, there is an increase in elongation owing to retained austenite and soft ferrite being included in the steel sheet microstructure. Therefore, in order to achieve good elongation and stretch flange formability while achieving strength of 1180 MPa or more, it is preferable to decrease a difference in hardness among constituent phases in a microstructure by forming a microstructure including retained austenite with a small volume fraction of ferrite.

b) Although there is an increase in yield ratio in the case where bainite and tempered martensite have a high dislocation density in a steel sheet microstructure, there is only a small influence on elongation.

Therefore, the present inventors diligently conducted investigations, and, as a result, found that, by controlling the volume fractions of soft phases, from which voids originate, and hard phases, and by controlling the distribution of cementite grains precipitated in a hard intermediate phase such as tempered martensite or bainite, it is possible to achieve an increase in elongation and a high yield ratio while achieving satisfactory strength and stretch flange formability as a result of decreasing the difference in hardness from the hard phases.

In addition, it was found that, specifically, by adding B in an appropriate amount, by forming a microstructure of a hot-rolled steel sheet including a uniform bainite structure (the volume fraction of bainite at a position located at ¼ of the thickness in the thickness direction is 100%), by performing a heat treatment (first heat treatment) in order to control the distributions of chemical elements and carbides in the hot-rolled steel sheet, by then performing cold rolling on such a hot-rolled steel sheet, and by then controlling conditions, for example, cooling conditions and holding conditions after cooling has been performed in a continuous annealing process (second heat treatment), since it is possible to control bainite transformation, the formation of retained austenite, and the distribution of cementite precipitated mainly in bainite and tempered martensite, it is possible to manufacture a steel sheet having the desired microstructure.

Here, it is important to use B as a quench hardenability increasing chemical element. That is, in the case where, for example, Mn is added in an excessive amount as a quench hardenability increasing chemical element, there is an increase in the hardness of tempered martensite and martensite, and there is a decrease in the martensite transformation start temperature. Therefore, it is necessary that a cooling stop temperature be lowered in a cooling process which is performed prior to a tempered-martensite-forming process and in which martensite transformation occurs. There is an increase in cost because an excessive cooling capacity is needed. By adding B, since it is possible to achieve satisfactory hardenability without decreasing the martensite transformation start temperature, there is a decrease in the otherwise necessary cost for cooling. Moreover, by adding B, it is also possible to suppress the formation of ferrite and pearlite in a cooling process after finish rolling has been performed in a hot-rolling process, which is effective for achieving the steel sheet microstructure of a hot-rolled steel sheet including a uniform bainite structure. In addition, after having achieved the microstructure of a hot-rolled steel sheet including a uniform bainite structure, by homogenizing the concentration distributions of C and Mn in a first heat treatment which is subsequently performed, and by further controlling a heating rate to be within a specified range in a second heat treatment which is subsequently performed, since it is possible to decrease the grain diameters of ferrite and martensite and to control the distribution of cementite grains, it is possible to form the desired steel sheet microstructure.

The present inventors found that, by controlling Mn content to be 2.4% or more and 3.5% or less, by adding B in an amount of 0.0002% or more and 0.0050% or less, and by further controlling conditions of annealing performed after hot rolling and cold rolling have been performed, it is possible to control the distribution of cementite grains to be precipitated while decreasing the grain diameters of ferrite and martensite and controlling the volume fraction of retained austenite to be sufficient to achieve satisfactory elongation. In addition, the present inventors found that, by controlling the volume fractions of ferrite, bainite, tempered martensite, and martensite to be within specified ranges, it is possible to increase elongation and stretch flange formability while achieving a high yield ratio.

Aspects of the present invention have been completed on the basis of the findings described above, and the subject matter of aspects of the present invention is as follows. Here, aspects of the present invention are intended for a high-strength cold-rolled steel sheet having a tensile strength of 1180 MPa or more.

[1] A high-strength cold-rolled steel sheet having a chemical composition containing, by mass %, C: 0.15% or more and 0.30% or less, Si: 0.8% or more and 2.4% or less, Mn: 2.4% or more and 3.5% or less, P: 0.08% or less, S: 0.005% or less, Al: 0.01% or more and 0.08% or less, N: 0.010% or less, Ti: 0.002% or more and 0.05% or less, B: 0.0002% or more and 0.0050% or less, and the balance being Fe and inevitable impurities, a microstructure including ferrite having an average grain diameter of 3 μm or less and a volume fraction of 5% or less (including 0%), retained austenite having a volume fraction of 10% or more and 20% or less, martensite having an average grain diameter of 4 μm or less and a volume fraction of 20% or less (including 0%), and the balance including bainite and/or tempered martensite, in which an average number of cementite grains having a grain diameter of 0.1 μm or more per 100 $\mu m^2$ in a cross section in the thickness direction parallel to the rolling direction of the steel sheet is 30 or more.

[2] The high-strength cold-rolled steel sheet according to item [1] above, the steel sheet having the chemical composition further containing, by mass %, one or more selected from V: 0.10% or less and Nb: 0.10% or less.

[3] The high-strength cold-rolled steel sheet according to item [1] or [2] above, the steel sheet having the chemical composition further containing, by mass %, one or more selected from Cr: 0.50% or less, Mo: 0.50% or less, Cu: 0.50% or less, and Ni: 0.50% or less.

[4] The high-strength cold-rolled steel sheet according to any one of items [1] to [3] above, the steel sheet having the chemical composition further containing, by mass %, Ca and/or REM in an amount of 0.0050% or less in total.

[5] A method for manufacturing a high-strength cold-rolled steel sheet, the method including performing hot rolling on a steel slab having the chemical composition according to any one of items [1] to [4] above with a hot rolling start temperature of 1150° C. or higher and 1300° C. or lower and a finishing delivery temperature of 850° C. or higher and 950° C. or lower, starting cooling within one second after hot rolling has been performed, performing first cooling to a temperature of 650° C. or lower at a first average cooling rate of 80° C./s or more, subsequently performing second cooling to a temperature of 550° C. or lower at a second average cooling rate of 5° C./s or more, then coiling the cooled steel sheet at a coiling temperature of 550° C. or lower, then performing a first heat treatment in which the coiled steel sheet is held in a temperature range of 400° C. or higher and 750° C. or lower for 30 seconds or more, subsequently performing cold rolling, and performing continuous annealing as a second heat treatment, in which the cold-rolled steel sheet is heated to a temperature range of 830° C. or higher at an average heating rate of 3° C./s or more and 30° C./s or less, in which the heated steel sheet is held at a first soaking temperature of 830° C. or higher for 30 seconds or more, in which the held steel sheet is then cooled from the first soaking temperature to a cooling stop temperature range expressed by Ta° C., which satisfies relational expression (1) below, at an average cooling rate of 3° C./s or more, in which the cooled steel sheet is subsequently heated to a temperature range expressed by Tb° C., which satisfies relational expression (2) below, in which the heated steel sheet is held at a second soaking temperature in a temperature range expressed by Tb° C., which satisfies relational expression. (2) below, for 20 seconds or more, and in which the held steel sheet is then cooled to room temperature.

$$0.35 \leq 1-\exp\{-0.011\times(561-[C]\times474-[Mn]\times33-[Ni]\times17-[Cr]\times17-[Mo]\times21-Ta)\} \leq 0.95 \quad \text{Relational expression (1):}$$

$$-3.0 \leq 1-\exp\{-0.011\times(561-[C]\times474-[Mn]\times33-[Ni]\times17-[Cr]\times17-[Mo]\times21-Tb)\} < 0.35 \quad \text{Relational expression (2):}$$

Here, symbol [M] in each relational expression denotes the content (mass %) of the chemical element denoted by M.

According to aspects of the present invention, by controlling the chemical composition and microstructure of a steel sheet, it is possible to stably obtain a high-strength cold-rolled steel sheet excellent in terms of both elongation and stretch flange formability having a tensile strength of 1180 MPa or more, a yield ratio of 75% or more, an elongation of 17% or more, and a hole expansion ratio of 30% or more.

DETAILED DESCRIPTION OF EMBODIMENTS OF THE INVENTION

First, the reasons for the limitations on the chemical composition of the high-strength cold-rolled steel sheet according to aspects of the present invention will be described. Hereinafter, "%" used when describing the chemical composition of steel refers to mass %.

C: 0.15% or more and 0.30% or less

C is a chemical element which is effective for increasing the strength of a steel sheet and contributes to an increase in strength by being involved in the formation of a second phase in accordance with aspects of the present invention such as bainite, tempered martensite, retained austenite, and martensite. Moreover, C increases the hardness of martensite and tempered martensite, in the case where the C content is less than 0.15%, it is difficult to achieve necessary volume fractions of bainite, tempered martensite, retained austenite, and martensite. Therefore, the C content is set to be 0.15% or more, or preferably 0.16% or more. On the other hand, in the case where the C content is more than 0.30%, since there is an increase in the difference in hardness among ferrite, tempered martensite, and martensite, stretch flange formability is deteriorated. Therefore, the C content is set to be 0.30% or less, or preferably 0.26% or less.

Si: 0.8% or more and 2.4% or less

Si contributes to the formation of retained austenite by suppressing the formation of carbides when bainite transformation occurs in order to form a sufficient amount of retained austenite, it is necessary that the Si content be 0.8% or more, or preferably 1.2% or more. However, since there is a decrease in phosphatability in the case where the Si content is excessively large, the Si content is set to be 2.4% or less, or preferably 2.1% or less.

Mn: 2.4% or more and 3.5% or less

Mn is a chemical element which contributes to an increase in strength through solid solution strengthening and by forming second phases. Also, since Mn is a chemical element which stabilizes austenite, Mn is a chemical element which is necessary for controlling the fractions of the second phases. Moreover, Mn is a chemical element which is necessary for homogenizing the microstructure of a hot-rolled steel sheet through bainite transformation. In order to realize such effects, it is necessary that the Mn content be 2.4% or more. On the other hand, in the case where the Mn content is excessively large, since there is an excessive increase in the volume fraction of martensite, and since there is an increase in the hardness of martensite and tempered martensite, there is a decrease in stretch flange formability. Therefore, the Mn content is set to be 3.5% or less, or preferably 3.3% or less.

P: 0.08% or less

Although P contributes to an increase in strength through solid solution strengthening, in the case where the P content is excessively large, since grain boundary segregation markedly occurs, intergranular embrittlement occurs and weldability is deteriorated. Therefore, the P content is set to be 0.08% or less, or preferably 0.05% or less.

S: 0.005% or less

In the case where the S content is large, since large amounts of sulfides such as MnS are formed, local elongation such as stretch flange formability is deteriorated. Therefore, the upper limit of the S content is set to be 0.005%, or it is preferable that the S content be 0.0045% or less. Although there is no particular limitation on the lower limit, since there is an increase in steel making costs in order to significantly decrease the S content, it is preferable that the lower limit of the S content be 0.0005%.

Al: 0.01% or more and 0.08% or less

Al is a chemical element which is necessary for deoxidation, and it is necessary that the Al content be 0.01% or more in order to realize such an effect. On the other hand, since the effect becomes saturated in the case where the Al content is more than 0.08%, the Al content is set to be 0.08% or less, or preferably 0.05% or less.

N: 0.010% or less

Since N decreases bendability and stretch flange formability by forming coarse nitrides, it is necessary to limit the N content. In the case where the N content is more than 0.010%, since such a trend becomes noticeable, the N content is set to be 0.010% or less, or preferably 0.0050% or less.

Ti: 0.002% or more and 0.05% or less

Ti is a chemical element which can contribute to an increase in strength by forming fine carbonitrides. Also, since Ti is more likely than B to form nitrides, Ti is necessary to prevent B, which is an essential chemical element for aspects of the present invention, from reacting with N. In order to realize such effects, it is necessary that the lower limit of the Ti content be 0.002%, or preferably 0.005%. On the other hand, in the case where the Ti content is large, since there is a significant decrease in elongation, the Ti content is set to be 0.05% or less, or preferably 0.035 or less.

B: 0.0002% or more and 0.0050% or less

B is a chemical element which increases hardenability without decreasing the martensite transformation start temperature and which contributes to an increase in strength by forming second phases. Moreover, B is effective for suppressing the formation of ferrite and pearlite when cooling is performed after finish rolling has been performed in a hot rolling process. In order to realize such effects, it is necessary that the B content be 0.0002% or more, or preferably 0.0003% or more. On the other hand, since the effects become saturated in the case where the B content is more than 0.0050%, the B content is set to be 0.0050% or less, or preferably 0.0040% or less.

In addition, in accordance with aspects of the present invention, one or more selected from V: 0.10% or less and Nb: 0.10% or less; one or more selected from Cr: 0.50% or less, Mo: 0.50% or less, Cu: 0.50% or less, and Ni: 0.50% or less; and Ca and/or REM in an amount of 0.0050% or less in total may further be added separately or in combination in addition to the constituent chemical elements described above for the reasons described below.

V: 0.10% or less

V can contribute to an increase in strength by forming fine carbonitrides. Since V functions in such a manner, it is preferable that the V content be 0.01% or more. On the other hand, in the case where the V content is large, there is only a small additional effect of increasing strength corresponding to an increase in V content in the case where the V content is more than 0.10%, and there is an increase in alloy costs. Therefore, the V content is set to be 0.10% or less, or preferably 0.05% or less.

Nb: 0.10% or less

Since Nb, like V, can also contribute to an increase in strength by forming fine carbonitrides, Nb may be added as needed. In order to realize such an effect, it is preferable that the Nb content be 0.005% or more. On the other hand, since elongation is significantly deteriorated in the case where the Nb content is large, the Nb content is set to be 0.10% or less, or preferably 0.05% or less.

Cr: 0.50% or less

Since Cr is a chemical element which contributes to an increase in strength by forming second phases, Cr may be added as needed. In order to realize such an effect, it is preferable that the Cr content be 0.10% or more. On the other hand, since an excessive amount of martensite is formed in the case where the Cr content is more than 0.50%, the Cr content is set to be 0.50% or less.

Mo: 0.50% or less

Mo is, like Cr, also a chemical element which contributes to an increase in strength by forming second phases. Since Mo is also a chemical element which contributes to an increase in strength by partially forming carbides, Mo may be added as needed. In order to realize such effects, it is preferable that the Mo content be 0.05% or more. Since the effects become saturated in the case where the Mo content is more than 0.50%, the Mo content is set to be 0.50% or less.

Cu: 0.50% or less

Cu is, like Cr, a chemical element which contributes to an increase in strength by forming second phases. Since Cu is also a chemical element which contributes to an increase in strength through solid solution strengthening, Cu may be added as needed. In order to realize such effects, it is preferable that the Cu content be 0.05% or more. On the other hand, since the effects become saturated and surface defects caused by Cu tends to occur in the case where the Cu content is more than 0.50%, the Cu content is set to be 0.50% or less.

Ni: 0.50% or less

Since Ni is a chemical element which, like Cr, contributes to an increase in strength by forming second phases and which, like Cu, contributes to an increase in strength through solid solution strengthening, Ni may be added as needed. In order to realize such effects, it is preferable that the Ni content be 0.05% or more. In addition, since Ni is effective for suppressing formation of surface defects caused by Cu in the case where Ni is added along with Cu, Ni is particularly effective in the case where Cu is added. On the other hand, since the effects become saturated in the case where the Ni content is more than 0.50%, the Ni content is set to be 0.50% or less.

Ca and/or REM: 0.0050% or less in total

Since Ca and REM are chemical elements which contribute to improving the negative effect of sulfides on stretch flange formability by spheroidizing the shape of sulfides, Ca and REM may be added as needed. In order to realize such an effect, it is preferable that one or more of Ca and REM be added in an amount of 0.0005% or more in total. On the other hand, in the case where Ca and/or REM are added in an amount of more than 0.0050% in total, the effect becomes saturated. Therefore, in the case where Ca and REM are added separately or in combination, the total content is set to be 0.0050% or less.

The remaining constituent chemical elements other than those described above are Fe and inevitable impurities. Examples of inevitable impurities include Sb, Sn, Zn, and Co. The acceptable ranges of the contents of these chemical elements are respectively Sb: 0.01% or less, Sn: 0.1% or less, Zn: 0.01% or less, and Co: 0.1% or less. In addition, even in the case where Ta, Mg, and Zr are added within the ordinary ranges of a steel chemical composition, the effects of aspects of the present invention is still obtainable.

Hereafter, the microstructure of the high-strength cold-rolled steel sheet according to aspects of the present invention will be described in detail.

The high-strength cold-rolled steel sheet according to aspects of the present invention has a microstructure including ferrite having an average grain diameter of 3 μm or less and a volume fraction of 5% or less (including 0%), retained austenite having a volume fraction of 10% or more and 20% or less, martensite having an average grain diameter of 4 μm or less and a volume fraction of 20% or less (including 0%), and the balance including bainite and/or tempered martensite, in which an average number of cementite grains having a grain diameter of 0.1 μm or more per 100 $\mu m^2$ in a cross section in the thickness direction parallel to the rolling direction of the steel sheet is 30 or more.

Ferrite: having an average grain diameter of 3 μm or less and a volume fraction of 5% or less (including 0%)

Since ferrite is a soft structure, voids tend to be formed at the interface with martensite or retained austenite having a high hardness when punching is performed as described above. In the case where the volume fraction of ferrite is more than 5%, since there is an increase in the amount of voids formed when punching is performed, stretch flange formability is deteriorated. Also, in the case where the volume fraction of ferrite is more than 5%, since it is necessary to increase the hardness of martensite and tempered martensite in order to achieve a high strength, it is difficult to achieve satisfactory strength and stretch flange formability at the same time. Therefore, the volume fraction of ferrite is set be 5% or less, preferably 3% or less, or more preferably 1% or less. Here, the volume fraction of ferrite may be 0%. In addition, in the case where the average grain diameter of ferrite is more than 3 μm, since voids formed in the punched edge surface tend to combine with each other when hole expansion or the like is being performed, it is not possible to achieve good stretch flange formability. Therefore, in the case where ferrite is included in the microstructure, the average grain diameter of ferrite is set to be 3 μm or less, Retained austenite: having a volume fraction of 10% more and 20% or less In order to achieve good ductility, it is necessary that the volume fraction of retained austenite be 10% or more and 20% or less. Since only low elongation is achieved in the case where the volume fraction of retained austenite is less than 10%, the volume fraction of retained austenite is set to be 10% or more, or preferably 11% or more. In addition, since stretch flange formability is deteriorated in the case where the volume fraction of retained austenite is more than 20%, the volume fraction of retrained austenite is set to be 20% or less, or preferably 18% or less.

Martensite: having an average grain diameter of 4 μm or less and a volume fraction of 20% or less (including 0%)

In order to achieve satisfactory stretch flange formability while achieving the desired strength, the volume fraction of martensite is set to be 20% or less, preferably 15% or less, or more preferably 12% or less. Here, the volume fraction of martensite may be 0%. In addition, since voids formed at the interface with ferrite tend to combine with each other in the case where the average grain diameter of martensite is more than 4 μm, stretch flange formability is deteriorated. Therefore, the average grain diameter of martensite is set to be 4 μm or less. It is preferable that the upper limit of the average grain diameter of martensite be 3 μm.

Remainder of microstructure: microstructure including bainite and/or tempered martensite In order to achieve good stretch flange formability and a high yield ratio, it is necessary that bainite and/or tempered martensite be included in the remainder of the microstructure in addition to ferrite, retained austenite, and martensite described above. It is preferable that the volume fraction of bainite be 15% or more and 50% or less and the volume fraction of tempered martensite be 30% or more and 70% or less. In addition, it is preferable that bainite and tempered martensite be included. It is preferable that the average grain diameter of tempered martensite be 12 μm or less. Here, "volume fraction of a bainite phase" refers to the volume proportion of bainitic ferrite (ferrite having a high dislocation density) to an observed surface.

Average number of cementite grains having a grain diameter of 0.1 μm or more per 100 $\mu m^2$ in a cross section in the thickness direction parallel to the rolling direction of the steel sheet: 30 or more In order to achieve good hole expansion formability and a high yield ratio, it is necessary that the number of cementite grains having a grain diameter of 0.1 μm or more be 30 or more on average per 100 $\mu m^2$ in a cross section of the steel sheet. Here, "cross section of the steel sheet" refers to a cross section in the thickness direction parallel to the rolling direction of the steel sheet. Cementite grains are precipitated mainly in bainite or tempered martensite. In the case where, among such cementite grains, the number of cementite grains precipitated having a grain diameter of 0.1 μm or more is less than 30 on average per 100 $\mu m^2$, since there is an increase in the hardness of tempered martensite and bainite, voids tend to be formed at the interfaces with a soft phase (ferrite) and hard phases (martensite and retained austenite), which results in a decrease in stretch flange formability. It is preferable that the number of cementite grains be 45 or more.

Although pearlite and the like may be formed in the microstructure according to aspects of the present invention in addition to ferrite, retained austenite, martensite, bainite, and tempered martensite described above, it is possible to achieve the object of aspects of the present invention as long as the above-described limitations on the volume fractions of ferrite, retained austenite, and martensite, the average grain diameters of ferrite and martensite, and the distribution of cementite grains are satisfied. However, it is preferable that the total volume fraction of microstructure, pearlite or the like, other than ferrite, retained austenite, martensite, bainite, and tempered martensite described above be 3% or less.

It is possible to determine the volume fractions and average grain diameters in the microstructure according to aspects of the present invention by using the methods described in the examples below. Also, it is possible to determine the average number of cementite grains having a grain diameter of 0.1 μm or more by using the method described in the examples below.

Hereafter, the method for manufacturing the high-strength cold-rolled steel sheet according to aspects of the present invention will be described.

It is possible to manufacture the high-strength cold-rolled steel sheet according to aspects of the present invention by performing hot rolling on a steel slab having the chemical composition described above with a hot rolling start temperature of 1150° C. or higher and 1300° C. or lower and a finishing delivery temperature of 850° C. or higher and 950° C. or lower, by starting cooling within one second after hot rolling has been performed, by performing first cooling to a temperature of 650° C. or lower at a first average cooling rate of 80° C./s or more, by subsequently performing second cooling to a temperature of 550° C. or lower at a second average cooling rate of 5° C./s or more, by then coiling the cooled steel sheet at a coiling temperature of 550° C. or lower, by performing a first heat treatment in which the coiled steel sheet is then held in a temperature range of 400° C. or higher and 750° C. or lower for 30 seconds or more, by subsequently performing cold rolling, and by performing continuous annealing as a second heat treatment, in which the cold-rolled steel sheet is heated to a temperature range of 830° C. or higher at an average heating rate of 3° C./s or more and 30° C./s or less, in which the heated steel sheet is held at a first soaking temperature of 830° C. or higher for 30 seconds or more, in which the held steel sheet is then cooled from the first soaking temperature to a cooling stop temperature range expressed by Ta° C., which satisfies relational expression (1) below, at an average cooling rate of 3° C./s or more, in which the cooled steel sheet is subsequently heated to a temperature range expressed by Tb° C., which satisfies relational expression (2) below, in which the heated steel sheet is held at a second soaking temperature in a temperature range expressed by Tb° C., which satisfies relational expression (2) below, for 20 seconds or more, and in which the held steel sheet is then cooled to room temperature.

$$0.35 \leq 1-\exp\{-0.011\times(561-[C]\times474-[Mn]\times33-[Ni]\times17-[Cr]\times17-[Mo]\times21-Ta)\} \leq 0.95 \quad \text{Relational expression (1):}$$

$$-3.0 \leq 1-\exp\{-0.011\times(561-[C]\times474-[Mn]\times33-[Ni]\times17-[Cr]\times17-[Mo]\times21-Tb)\} < 0.35 \quad \text{Relational expression (2):}$$

Here, symbol [M] in each relational expression denotes the content (mass %) of the chemical element denoted by M.

As described above, it is possible to manufacture the high-strength cold-rolled steel sheet according to aspects of the present invention by performing a hot rolling process in which hot-rolling, cooling, and coiling is performed, a first heat treatment process in which a first heat treatment is performed, a cold rolling process in which cold rolling is performed, and a second heat treatment process in which a second heat treatment is performed in this order on a steel slab having the chemical composition described above. Hereafter, the manufacturing conditions will be described in detail.

Here, although it is preferable that the steel slab which is used in accordance with aspects of the present invention be manufactured by using a continuous casting method in order to prevent macro segregation of the constituent chemical elements, an ingot-making method or a thin-slab-casting method may be used. In accordance with aspects of the present invention, in addition to a conventional method in which the manufactured steel slab is first cooled to room temperature and then reheated, it is possible to use, without causing any trouble, energy saving processing such as one in which the slab in the hot state is charged into a heating furnace without being cooled, one in which the slab is subjected to hot rolling immediately after heat retention has been performed, or hot direct rolling or direct rolling in which the slab as cast is directly subjected to rolling.

[Hot Rolling Process]

Hot rolling start temperature: 1150° C. or higher and 1300° C. or lower

After a steel slab having the chemical composition described above has been cast, of rolling is started by using the steel slab having a temperature of 1150° C. or higher and 1300° C. or lower without reheating the steel slab or after the steel slab has been reheated to a temperature of 1150° C. or higher and 1300° C. or lower in the case where the hot rolling start temperature is lower than 1150° C., there is a decrease in productivity due to an increase in rolling load. On the other hand, in the case where the hot rolling start temperature is higher than 1300° C., there is only an increase in heating costs. Therefore, the hot rolling start temperature is set to be 1150° C. or higher and 1300° C. or lower. Here, the slab temperature is defined as an average temperature in the thickness direction.

Finishing delivery temperature: 850° C. or higher and 950° C. or lower

It is necessary that hot rolling be finished in a temperature range in which an austenite single phase is formed in order to increase elongation and hole expansion formability after annealing has been performed as a result of the homogenization of a microstructure in a steel sheet and a decrease in the anisotropy of material properties. Therefore, the finishing delivery temperature of hot rolling is set to be 850° C. or higher. On the other hand, in the case where the finishing delivery temperature is higher than 950° C., since there is coarsening of the microstructure of a hot-rolled steel sheet, properties are deteriorated after annealing. Therefore, the finishing delivery temperature is set to be 950° C. or lower. Although there is no particular limitation on the thickness of a hot-rolled steel sheet after hot rolling has been performed, it is preferable that the thickness be 1.2 mm to 8.0 mm.

Cooling condition after hot rolling has been performed: starting cooling within one second after hot rolling has been performed, performing first cooling to a temperature of 650° C. or lower at a first average cooling rate of 80° C./s or more, subsequently performing second cooling to a temperature of 50° C. or lower at a second average cooling rate of 5° C./s or more By starting cooling within one second after hot rolling has been performed, and by performing rapid cooling to a temperature range in which bainite transformation occurs without the occurrence of ferrite transformation, the microstructure of a hot-rolled steel sheet is homogenized in the form of a bainite structure. Controlling the microstructure of a hot-rolled steel sheet in such a manner is effective for refining mainly of ferrite and martensite in the final steel sheet microstructure. In the case where time until starting cooling after hot rolling is more than one second, since ferrite transformation starts, it is difficult to realize uniform bainite transformation. Therefore, cooling (first cooling) is started within one second after hot rolling has been performed, that is, after the finish rolling of hot rolling has been performed, and then cooling is performed to a temperature of 650° C. or lower at an average cooling rate (first average cooling rate) of 80° C./s or more. In the case where the first average cooling rate, which is the average cooling rate of first cooling, is less than 80° C./s, since ferrite transformation starts during cooling is performed, the steel sheet microstructure of the hot-rolled steel sheet formed is non-uniform, which results in a decrease in the stretch flange formability of the steel sheet obtained finally. In addition, in the case where the cooling stop temperature of the first cooling is higher than 650° C., since an excessive amount of pearlite is formed, the steel sheet microstructure of the hot-rolled steel sheet formed is non-uniform, which results in a decrease in the stretch flange formability of the steel sheet obtained finally. Therefore, cooling is started within one second after hot rolling has been performed, and first cooling is performed to a temperature of 650° C. or lower at a first average cooling rate of 80° C./s or more. Here, "first average cooling rate" refers to the average cooling rate from the temperature when hot rolling has been performed to the cooling stop temperature of first cooling After first cooling has been performed as described above, second cooling is subsequently performed to a temperature of 550° C. or lower at an average cooling rate of 5° C./s or more. In the case where the second cooling rate, which is the average cooling rate of second cooling, is less than 5° C./s or where second cooling is performed to a temperature higher than 550° C., since ferrite or pearlite is formed in an excessive amount in the steel sheet microstructure of the hot-rolled steel sheet, there is a decrease in stretch flange formability of the steel sheet obtained finally. Therefore, second cooling is performed to a temperature of 550° C. or lower at a second average cooling rate of 5° C./s or more. Here, "second average cooling rate" refers to the average cooling rate from the cooling stop temperature of first cooling to a coiling temperature.

Coiling temperature: 550° C. or lower

After first cooling following hot rolling has been performed and then second cooling has been performed to a temperature of 550° C. or lower as described above, coiling is performed at a coiling temperature of 550° C. or lower. Since ferrite and pearlite are formed in excessive amounts in the case where the coiling temperature is higher than 550° C., the upper limit of the coiling temperature is set to be 550° C., or preferably 500° C. or lower. Although there is no particular limitation on the lower limit of the coiling temperature, since there is an increase in the rolling load of cold rolling because an excessive amount of hard martensite is formed in the case where the coiling temperature is excessively low, it is preferable that the lower limit be 300° C. or higher.

[Pickling Process]

After a hot rolling process has been performed, it is preferable that scale formed on the surface layer of the hot-rolled steel sheet in the hot rolling process be removed by performing a pickling process. There is no particular limitation on a pickling process, and a pickling process may be performed by using an ordinary method.

[First Heat Treatment Process]

First heat treatment: holding in a temperature range of 400° C. or higher and 750° C. or lower for 30 seconds or more In accordance with aspects of the present invention, after the hot rolling has been performed as described above, heat treatment is performed twice (first heat treatment and second heat treatment) before and after a cold rolling process. With this method, grain diameters are decreased and the distribution of cementite precipitated is controlled. The first heat treatment is performed after the hot rolling process in order to further homogenize the distributions of chemical elements such as C and Mn in the bainite uniform structure obtained in the hot rolling process. The first heat treatment eliminates the segregation of chemical elements such as C and Mn, and is important for achieving the desired microstructure after the second heat treatment process. In the case where the heat treatment temperature of the first heat treatment is lower than 400° C., since it is not possible to eliminate the influence of the distributions of chemical elements formed after hot rolling has been performed due to insufficient redistribution of chemical elements, there is an increase in hardenability in a region originally having a high C concentration due to the uneven distributions of C and Mn after the second heat treatment described below has been performed, which makes it impossible to achieve the desired steel sheet microstructure. Also, since there is a decrease in the number of cementite grains having a grain diameter of 0.1 μm or more after the second heat treatment has been performed, it is not possible to achieve sufficient, elongation and hole expansion formability. On the other hand, in the case where the heat treatment temperature of the first heat treatment is higher than 750° C., since coarse and hard martensite is formed in an excessive amount, there is a significant increase in strength due to a non-uniform microstructure formed after the second heat treatment has been performed and due to an increase in the volume fraction of martensite, which results in a significant decrease in elongation and hole expansion formability. Therefore, there is an optimum temperature range of the first heat treatment performed on a hot-rolled steel sheet in order to form a uniform microstructure in the hot-rolled steel sheet before cold rolling is performed, and the steel sheet is heated to a temperature range of 400° C. or higher and 750° C. or lower in the first heat treatment, that is, the heat treatment temperature of the first heat treatment is set to be 400° C. or higher and 750° C. or lower, preferably 450° C. or higher and 700° C. or lower, or more preferably 450° C. or higher and 650° C. or lower. In addition, in the case where the holding time in a temperature range of 400° C. or higher and 750° C. or lower is less than 30 seconds, since it is not possible to eliminate the influence of the distributions of chemical elements formed after hot rolling has been performed, it is not possible to achieve the desired steel sheet microstructure. It is preferable that the holding time be 300 seconds or more, or more preferably 600 seconds or more.

[Cold Rolling Process]

The hot-rolled steel sheet which has been subjected to the first heat treatment undergoes a cold rolling process in which the steel sheet is cold-rolled to a specified thickness. There is no particular limitation on what condition is used in the cold rolling process, and the cold rolling process may be performed by using an ordinary method.

[Second Heat Treatment Process]

The second heat treatment process is performed in order to progress recrystallization and to form bainite, tempered martensite, retained austenite, and martensite in the steel microstructure for the purpose of increasing strength.

For this purpose, continuous annealing is performed as the second heat treatment, in which the cold-rolled steel sheet is heated to a temperature range of 830° C. or higher at an average heating rate of 3° C./s or more and 30° C./s or less, in which the heated steel sheet is held at a first soaking temperature of 830° C. or higher for 30 seconds or more, in which the held steel sheet is then cooled from the first soaking temperature to a cooling stop temperature range expressed by Ta° C., which satisfies relational expression (1) below, at an average cooling rate of 3° C./s or more, in which the cooled steel sheet is subsequently heated to a temperature range expressed by Tb° C., which satisfies relational expression (2) below, in which the heated steel sheet is held at a second soaking temperature in a temperature range expressed by Tb° C., which satisfies relational expression (2) below, for 20 seconds or more, and in which the held steel sheet is then cooled to room temperature.

$$0.35 \leq 1-\exp\{-0.011\times(561-[C]\times474-[Mn]\times33-[Ni]\times17-[Cr]\times17-[Mo]\times21-Ta)\} \leq 0.95 \quad \text{Relational expression (1):}$$

$$-3.0 \leq 1-\exp\{-0.011\times(561-[C]\times474-[Mn]\times33-[Ni]\times17-[Cr]\times17-[Mo]\times21-Tb)\} < 0.35 \quad \text{Relational expression (2):}$$

Here, symbol [M] in the relational expression denotes the content (mass %) of the chemical element denoted by M.

The reasons for the limitations on the conditions will be described hereafter.

Average heating rate: 3° C./s or more and 30° C./s or less

By controlling the speeds of the nucleation of ferrite and austenite which are formed by recrystallization in a heating process when annealing is performed to be larger than the growing speeds of the recrystallized grains, it is possible to refine the recrystallized grains. For this purpose, the average heating rate in the second heat treatment up to a temperature range of 830° C. or higher is set to be 3° C./s or more. In the case where this heating rate is excessively small, since there is coarsening of ferrite and austenite which are formed in the heating process, it is not possible to achieve the desired average grain diameters due to coarsening of ferrite and martensite grains obtained finally. It is preferable that the average heating rate be 5° C./s or more. On the other hand, since it is difficult to progress recrystallization in the case where the heating rate is excessively large, the average heating rate is set to be 30° C./s or less. Therefore, the average heating rate when the cold-rolled steel sheet is heated to a temperature range of a soaking temperature of 830° C. or higher is set to be 3° C./s or more and 30° C./s or less. Here, "average heating rate" refers to the average heating rate from the temperature at which heating is started to the first soaking temperature.

First soaking temperature: 830° C. or higher

The cold-rolled steel sheet is heated to a temperature range of 830° C. or higher at an average heating rate of 3° C./s or more and 30° C./s or less as described above, and then, the heated steel sheet is held at a first soaking temperature of 830° C. or higher so that recrystallization occurs. The first soaking temperature is set to be in a temperature range in which a ferrite-austenite dual phase is formed or in which an austenite single phase is formed in the case where the first soaking temperature is lower than 830° C., since there is an increase in ferrite fraction, it is difficult to achieve satisfactory strength and stretch flange formability at the same time. Therefore, the lower limit of the first soaking temperature is set to be 830° C. Although there is no particular limitation on the upper limit of the first soaking temperature, since it is difficult to achieve the desired martensite grain diameter after annealing due to an increase in austenite grain diameter when annealing is performed in the case where the soaking temperature is excessively high, it is preferable that the upper limit be 900° C. or lower.

Holding time at the first soaking temperature: 30 seconds or more

In order to progress recrystallization and austenite transformation partially or completely at the first soaking temperature, it is necessary that the holding time (soaking time) at the first soaking temperature be 30 seconds or more. Although there is no particular limitation on the upper limit of the holding time, it is preferable that the upper limit be 600 seconds or less.

Cooling from the first soaking temperature to a cooling stop temperature range expressed by Ta° C., which satisfies relational expression (1) below, at an average cooling rate of 3° C./s or more $$0.35 \leq 1-\exp\{-0.011\times(561-[C]\times474-[Mn]\times33-[Ni]\times17-[Cr]\times17-[Mo]\times21-Ta)\} \leq 0.95 \quad \text{Relational expression (1):}$$

In order to transform a part of austenite formed during the holding time at the first soaking temperature into martensite, cooling is performed to a temperature range expressed by Ta° C., which satisfies relational expression (1) above, at an average cooling rate of 3° C./s or more. In the case where the average cooling rate from the first soaking temperature to a temperature range expressed by Ta° C. is less than 3° C./a, since ferrite transformation excessively progresses, it is difficult to achieve the desired volume fractions, and an excessive amount of pearlite is formed. Therefore, the lower limit of the average cooling rate from the first soaking temperature to a temperature range expressed by Ta° C. is set to be 3° C./s. Here, "average cooling rate" refers to the average cooling rate from the first soaking temperature to Ta.

Hereafter, the description will be continued under the assumption that $1-\exp\{-0.011\times(561-[C]\times474-[Mn]\times33-[Ni]\times17-[Cr]\times17-[Mo]\times21-Ta)\}=A$. In the case where the cooling stop temperature is expressed by Ta, which satisfies the relationship $A>0.95$, since an excessive amount of martensite is formed when cooling is performed, there is a decrease in the amount of untransformed austenite. In addition, since there is a decrease in the amounts of bainite transformation and retained austenite, elongation is deteriorated. On the other hand, in the case where the cooling stop temperature is expressed by Ta° C., which satisfies the relationship $A<0.35$, since there is a decrease in the amount of tempered martensite, it is not possible to achieve the specified number of cementite grains, which results in deteriorated stretch flange formability. Therefore, the cooling stop temperature Ta° C. is set to be within the temperature range which satisfies the relational expression (1) above.

Following cooling to the temperature range expressed by Ta° C., heating to a temperature range expressed by Tb° C., which satisfies relational expression (2) below, holding the heated steel sheet at a second soaking temperature in a temperature range expressed by Tb° C., which satisfies relational expression (2) below, for 20 seconds or more, and then cooling the held steel sheet to room temperature $$-3.0 \leq 1-\exp\{-0.011\times(561-[C]\times474-[Mn]\times33-[Ni]\times17-[Cr]\times17-[Mo]\times21-Tb)\} < 0.35 \quad \text{Relational expression (2):}$$

After cooling has been performed to the temperature range expressed by Ta° C. described above, reheating is performed and the reheated steel sheet is held in a second soaking temperature range in order to form tempered martensite by tempering martensite formed in the middle of cooling and in order to form bainite and retained austenite in the steel sheet microstructure by transforming untransformed austenite into bainite. Since cementite grains grow by performing reheating to a temperature range expressed by Tb° C., which satisfies relational expression (2), and by holding the steel sheet in the temperature range, it is possible to achieve good elongation and stretch flange formability while achieving a high yield ratio.

Hereafter, the description will be continued under the assumption that $1-\exp\{-0.011\times(561-[C]\times474-[Mn]\times33-[Ni]\times17-[Cr]\times17-[Mo]\times21-Tb)\}=B$. In the case where the second soaking temperature Tb° C. satisfies the relationship $B<-3.0$, since an excessive amount of pearlite is formed, there is a decrease in elongation. In addition, in the case where the second soaking temperature Tb° C. satisfies the relationship $B\geq0.35$, since cementite grains do not grow because martensite is insufficiently tempered, voids tend to be formed, which results in deteriorated stretch flange formability. In addition, in the case where the holding time in the temperature range expressed by Tb° C., which satisfies the relationship $-3.0\leq B<0.35$, is less than 20 seconds, since there is an increase in the amount of untransformed austenite retained because bainite transformation insufficiently progresses, an excessive amount of martensite is finally formed, which results in a decrease in stretch flange formability. Therefore, heating is performed to the second soaking temperature in the temperature range expressed by Tb° C., which satisfies relational expression (2), the heated steel sheet is held at the second soaking temperature in a temperature range expressed by Tb° C., which satisfies relational expression (2), for 20 seconds or more, and then, the held steel sheet is cooled to room temperature.

Tempered martensite is formed, for example, in the following manner. A part of untransformed austenite transforms into martensite during cooling is performed to a temperature of Ta° C. when annealing is performed, and tempered martensite is formed because the martensite is tempered when the steel sheet is held at a temperature of Tb° C. after heating to a temperature of Tb° C. has been performed. In addition, martensite is formed, for example, in the following manner. When austenite remaining untransformed even after the steel sheet has been held in the second soaking temperature range expressed by Tb° C. when continuous annealing is performed is cooled to room temperature, martensite is formed.

Here, skin pass rolling may be performed after the continuous annealing process described above, which is the second heat treatment process, has been performed. It is preferable that skin pass rolling be performed with an elongation ratio of 0.1% to 2.0%.

In addition, in the second heat treatment process described above, a galvanizing treatment may be performed to obtain a galvanized steel sheet, or further, an alloying treatment may be performed after galvanizing treatment has been performed to obtain a galvannealed steel sheet, as long as the steel sheet is within the range of aspects of the present invention. Moreover, the cold-rolled steel sheet obtained in accordance with aspects of the present invention may be subjected to an electroplating treatment in order to obtain an electroplated steel sheet.

EXAMPLE 1

Hereafter, the examples of the present invention will be described. However, it is needless to say that the present invention is not limited to the examples below, that the present invention may be carried out with appropriate modification as long as the modification meets the gist of the present invention, and that such an embodiment is within the technical scope of the present invention.

By preparing molten steels having the chemical compositions given in Table 1 (balance: Fe and inevitable impurities), by casting the molten steels in order to obtain slabs having a thickness of 230 mm, and by performing hot rolling with a hot rolling start temperature of 1250° C. and finishing delivery temperatures (FDT) given in Table 2, hot-rolled steel sheets having a thickness of 3.2 mm were obtained, and then, cooling was started within the times (times until starting cooling) given in Table 2, cooling was performed to the first cooling temperatures at the first average cooling rates (cooling rates 1) given in Table 2, cooling was then performed at the second average cooling rates (cooling rates 2), and coiling was performed at the coiling temperatures (CT). Subsequently, the obtained hot-rolled steel sheet were subjected to pickling, and then, the first heat treatment was performed at the first heat treatment temperatures for the first heat treatment times (holding times) given in Table 2. Subsequently, cold rolling was performed in order to manufacture cold-rolled steel sheets (thickness: 1.4 mm). Subsequently, annealing was performed as the second heat treatment, in which heating was performed to the first soaking temperatures given in Table 2 at the average heating rates given in Table 2, and in which the first soaking temperatures were held for the soaking times (first holding times) given in Table 2, cooling was then performed to the cooling stop temperatures (Ta° C.) at the average cooling rates (cooling rates 3) given in Table 2, heating was then performed to the second soaking temperatures (Tb° C.) given in Table 2, the second soaking temperatures were held for the times (second holding times) given in Table 2, and then, cooling was performed to room temperature.

The various properties of the obtained steel sheets manufactured as described above were evaluated as described below. The evaluation results are given in Table 3.

[Tensile Properties]

A tensile test (JIS Z 2241 (1998)) was performed on a JIS No. 5 tensile test piece which had been taken from the manufactured steel sheet so that the longitudinal direction (tensile direction) of the test piece is a direction at a right angle to the rolling direction in order to determine yield stress (YS), tensile strength (TS), and total elongation (EL), and then, a yield ratio (YR) was derived.

[Stretch Flange Formability]

The hole expansion ratio (X) of a test piece taken from the manufactured steel sheet was determined in accordance with The Japan Iron and Steel Federation Standard (JFST 1001 (1996)), by punching a hole having a diameter of 10 mmϕ with a clearance of 12.5% of the thickness out of the test piece, by setting the test piece on the testing machine so that the burr was on the die side, and then by forming the test piece by using a conical punch having a tip angle of 60°. A case where λ (%) was 30% or more was judged as a case of a steel sheet having a good stretch flange formability.

[Steel Sheet Microstructure]

The volume fraction of each of ferrite and martensite of the steel sheet was defined as an area ratio which was obtained by polishing a cross section in the thickness direction parallel to the rolling direction of the steel sheet, then by etching the polished cross section by using a 3%-nital solution, by observing the etched cross section by using a SEM (scanning electron microscope) at magnifications of 2000 times and 5000 times, and by determining the area ratio by using a point count method (in accordance with ASTM E562-83 (1988)). The average grain diameter of each of ferrite and martensite was derived by calculating the average value of the circle-equivalent diameters of the areas of the grains of each of ferrite and martensite which was calculated by using. Image-Pro manufactured by Media Cybernetics, Inc. from the photograph of the steel sheet microstructure in which grains of each of ferrite and martensite were distinguished from other phases.

The grain diameter of cementite was, as is the case with ferrite and martensite, derived by performing observation with a SEM (scanning electron microscope) and a TEM (transmission electron microscope) at magnifications of 5000 times, 10000 times, and 20000 times and by calculating a circle-equivalent diameter with Image-Pro.

The number of cementite grains having a grain diameter of 0.1 μm or more per 100 $\mu m^2$ was defined as the average value of the numbers thereof in 10 portions derived by performing observation with a SEM (scanning electron microscope) and a TEM (transmission electron microscope) at magnifications of 5000 times, 10000 times, and 20000 times.

The volume fraction of retained austenite was derived from the X-ray diffraction intensity in the surface located at ¼ of the thickness of the steel sheet determined by polishing the steel sheet to the surface located at ¼ of the thickness in the thickness direction. The volume fraction of retained austenite was derived by using the Kα-ray of Mo as a radiation source with an accelerating voltage of 50 keV, by determining the integrated intensities of X-ray diffraction of the {200} plane, {211} plane, and {220} plane of the ferrite of iron and the {200} plane, {220} plane, and {31.1} plane of the austenite of iron with an X-ray diffraction method (apparatus: RINT-2200 produced by Rigaku Corporation), and by using the calculating formula described in "X-ray Diffraction Handbook" (2000) published by Rigaku Corporation, pp. 26 and 62-64.

In addition, the kinds of steel microstructures other than ferrite, retained austenite, and martensite were identified by observing a steel sheet microstructure with a SEM (scanning electron microscope), a TEM (transmission electron microscope), and an FE-SEM (field emission scanning electron microscope).

The tensile properties, the hole expansion ratio, the average number of cementite grains, and the steel sheet microstructure obtained as described above are given in Table 3. From the results given in Table 3, it is clarified that all the examples of the present invention had multi-phase microstructures including ferrite having an average grain diameter of 3 μm or less and a volume fraction of 5% or less, retained austenite having a volume fraction of 10% or more and 20% or less, martensite having an average grain diameter of 4 μm or less and a volume fraction of 20% or less, and the balance being bainite and/or tempered martensite, in which an average number of cementite grains having a grain diameter of 0.1 μm or more per 100 $\mu m^2$ in the cross section of the steel sheet is 30 or more. Such steel sheets of the examples of the present invention achieved good workability indicated by an elongation of 17% or more and an hole expansion ratio of 30% or more while achieving a tensile strength of 1180 MPa or more and a yield ratio of 75% or more. On the other hand, since the steel sheet microstructures of the comparative examples were out of the range according to the present invention, the comparative examples were poor in terms of at least one of tensile strength, yield ratio, elongation, and hole expansion ratio.

TABLE 1

| Steel | Chemical Composition (mass %) | | | | | | | | | | |
|---|---|---|---|---|---|---|---|---|---|---|---|
| Grade | C | Si | Mn | P | S | Al | N | Ti | B | Other | Note |
| A | 0.19 | 1.53 | 3.05 | 0.01 | 0.002 | 0.03 | 0.002 | 0.016 | 0.0012 | — | Example |
| B | 0.22 | 1.48 | 2.88 | 0.01 | 0.001 | 0.03 | 0.003 | 0.013 | 0.0018 | — | Example |
| C | 0.20 | 1.39 | 2.81 | 0.01 | 0.001 | 0.03 | 0.002 | 0.012 | 0.0022 | V: 0.02 | Example |
| D | 0.18 | 1.77 | 2.78 | 0.01 | 0.002 | 0.02 | 0.002 | 0.005 | 0.0030 | Nb: 0.03 | Example |
| E | 0.22 | 1.42 | 2.63 | 0.01 | 0.001 | 0.03 | 0.002 | 0.020 | 0.0018 | Cr: 0.18 | Example |
| F | 0.23 | 0.96 | 2.50 | 0.01 | 0.001 | 0.03 | 0.001 | 0.031 | 0.0010 | Mo: 0.15 | Example |
| G | 0.22 | 2.11 | 2.65 | 0.02 | 0.003 | 0.04 | 0.003 | 0.022 | 0.0012 | Cu: 0.18 | Example |
| H | 0.18 | 1.18 | 3.12 | 0.01 | 0.002 | 0.03 | 0.002 | 0.012 | 0.0015 | Ni: 0.22 | Example |
| I | 0.21 | 1.35 | 2.89 | 0.02 | 0.002 | 0.03 | 0.002 | 0.015 | 0.0022 | Ca: 0.0028 | Example |
| J | 0.20 | 1.38 | 2.91 | 0.01 | 0.002 | 0.03 | 0.002 | 0.026 | 0.0032 | REM: 0.0028 | Example |
| K | 0.13 | 1.82 | 2.88 | 0.01 | 0.002 | 0.03 | 0.002 | 0.031 | 0.0030 | — | Comparative Example |
| L | 0.20 | 0.56 | 3.11 | 0.01 | 0.002 | 0.03 | 0.003 | 0.017 | 0.0011 | — | Comparative Example |
| M | 0.22 | 2.12 | 1.83 | 0.01 | 0.002 | 0.03 | 0.003 | 0.015 | 0.0020 | — | Comparative Example |
| N | 0.18 | 0.89 | 3.82 | 0.02 | 0.002 | 0.04 | 0.003 | 0.022 | 0.0013 | — | Comparative Example |

Underlined portion: indicates a value out of the range according to the present invention

TABLE 2

| | | Hot Rolling | | | | | | First Heat Treatment | |
|---|---|---|---|---|---|---|---|---|---|
| Sample No. | Steel Grade | FDT (° C.) | Time until Starting Cooling (sec) | Cooling Rate 1 (° C./s) | First Cooling Temperature (° C.) | Cooling Rate 2 (° C./s) | CT (° C.) | First Heat Treatment Temperature (° C.) | First Heat Treatment Time (sec) |
| 1 | A | 900 | 0.5 | 100 | 620 | 20 | 470 | 600 | 6000 |
| 2 | A | 900 | 0.5 | 120 | 600 | 20 | 450 | 580 | 60000 |
| 3 | B | 900 | 0.5 | 90 | 550 | 30 | 470 | 600 | 30000 |
| 4 | B | 900 | 0.5 | 100 | 600 | 25 | 470 | 600 | 90000 |
| 5 | B | 900 | 0.5 | 100 | 620 | 20 | 400 | 600 | 500 |
| 6 | C | 900 | 0.5 | 150 | 600 | 22 | 420 | 600 | 6000 |
| 7 | D | 900 | 0.5 | 120 | 580 | 20 | 470 | 600 | 8000 |
| 8 | E | 900 | 0.5 | 100 | 620 | 40 | 470 | 600 | 600 |
| 9 | F | 900 | 0.5 | 100 | 550 | 20 | 470 | 600 | 3600 |
| 10 | G | 900 | 0.5 | 100 | 600 | 15 | 540 | 640 | 3600 |
| 11 | H | 900 | 0.5 | 85 | 600 | 20 | 470 | 600 | 3600 |
| 12 | I | 900 | 0.5 | 100 | 650 | 25 | 470 | 600 | 10000 |
| 13 | J | 900 | 0.5 | 120 | 600 | 20 | 470 | 600 | 3600 |
| 14 | A | 800 | 0.5 | 100 | 600 | 20 | 470 | 600 | 6000 |
| 15 | A | 900 | 10 | 100 | 600 | 20 | 480 | 600 | 12000 |
| 16 | A | 900 | 0.5 | 50 | 600 | 20 | 470 | 500 | 6000 |
| 17 | A | 900 | 0.5 | 90 | 750 | 30 | 470 | 600 | 6000 |
| 18 | A | 900 | 0.5 | 100 | 600 | 2 | 470 | 600 | 6000 |
| 19 | A | 900 | 0.5 | 90 | 700 | 20 | 650 | 600 | 6000 |
| 20 | A | 900 | 0.5 | 100 | 600 | 25 | 470 | 300 | 6000 |
| 21 | A | 900 | 0.5 | 150 | 620 | 20 | 450 | 850 | 6000 |
| 22 | A | 900 | 0.5 | 150 | 600 | 20 | 490 | 600 | 20 |
| 23 | A | 900 | 0.5 | 100 | 600 | 15 | 470 | 600 | 6000 |
| 24 | A | 900 | 0.5 | 120 | 600 | 20 | 470 | 600 | 6000 |
| 25 | A | 900 | 0.5 | 100 | 600 | 20 | 450 | 600 | 6000 |
| 26 | A | 900 | 0.5 | 100 | 620 | 25 | 470 | 600 | 6000 |
| 27 | A | 900 | 0.5 | 100 | 600 | 20 | 470 | 600 | 6000 |
| 28 | A | 900 | 0.5 | 100 | 550 | 20 | 470 | 600 | 6000 |
| 29 | A | 900 | 0.5 | 100 | 600 | 20 | 450 | 640 | 6000 |
| 30 | A | 900 | 0.5 | 150 | 600 | 20 | 450 | 600 | 6000 |
| 31 | A | 900 | 0.5 | 100 | 580 | 20 | 470 | 600 | 6000 |
| 32 | K | 900 | 0.5 | 100 | 600 | 20 | 450 | 500 | 6000 |
| 33 | L | 900 | 0.5 | 100 | 600 | 20 | 450 | 600 | 6000 |
| 34 | M | 900 | 0.5 | 100 | 550 | 20 | 450 | 600 | 6000 |
| 35 | N | 900 | 0.5 | 100 | 600 | 20 | 470 | 600 | 6000 |

TABLE 2-continued

| Sample No. | Second Heat Treatment: Average Heating Rate (° C./s) | First Soaking Temperature (° C.) | First Holding Time (sec) | Cooling Rate 3 (° C./s) | Ta (° C.) | A* | Tb (° C.) | B** | Second Holding Time (sec) |
|---|---|---|---|---|---|---|---|---|---|
| 1 | 5 | 850 | 350 | 5 | 300 | 0.54 | 400 | −0.39 | 600 |
| 2 | 10 | 880 | 200 | 4 | 275 | 0.65 | 425 | −0.83 | 500 |
| 3 | 12 | 850 | 300 | 6 | 300 | 0.49 | 400 | −0.52 | 300 |
| 4 | 5 | 900 | 200 | 8 | 320 | 0.37 | 425 | −1.01 | 600 |
| 5 | 10 | 850 | 300 | 5 | 300 | 0.49 | 450 | −1.64 | 600 |
| 6 | 10 | 900 | 300 | 5 | 250 | 0.74 | 350 | 0.23 | 1000 |
| 7 | 10 | 850 | 300 | 5 | 300 | 0.60 | 380 | 0.04 | 600 |
| 8 | 10 | 850 | 600 | 8 | 250 | 0.72 | 400 | −0.44 | 600 |
| 9 | 10 | 875 | 300 | 9 | 300 | 0.52 | 450 | −1.51 | 600 |
| 10 | 25 | 850 | 300 | 7 | 250 | 0.73 | 400 | −0.40 | 600 |
| 11 | 3 | 900 | 500 | 10 | 220 | 0.81 | 480 | −2.39 | 300 |
| 12 | 10 | 850 | 200 | 8 | 275 | 0.63 | 450 | −1.52 | 180 |
| 13 | 4 | 900 | 300 | 11 | 300 | 0.54 | 400 | −0.39 | 500 |
| 14 | 5 | 850 | 300 | 10 | 290 | 0.59 | 400 | −0.39 | 500 |
| 15 | 10 | 850 | 300 | 11 | 300 | 0.54 | 410 | −0.55 | 400 |
| 16 | 10 | 850 | 300 | 12 | 275 | 0.65 | 430 | −0.93 | 600 |
| 17 | 10 | 875 | 300 | 5 | 300 | 0.54 | 450 | −1.40 | 600 |
| 18 | 10 | 850 | 300 | 4 | 300 | 0.54 | 400 | −0.39 | 600 |
| 19 | 10 | 875 | 300 | 7 | 300 | 0.54 | 400 | −0.39 | 600 |
| 20 | 5 | 840 | 200 | 5 | 300 | 0.54 | 400 | −0.39 | 600 |
| 21 | 5 | 850 | 300 | 8 | 275 | 0.65 | 420 | −0.73 | 600 |
| 22 | 5 | 840 | 200 | 5 | 300 | 0.54 | 400 | −0.39 | 600 |
| 23 | 1 | 850 | 300 | 4 | 300 | 0.54 | 410 | −0.55 | 600 |
| 24 | 10 | 800 | 300 | 10 | 300 | 0.54 | 400 | −0.39 | 600 |
| 25 | 5 | 850 | 10 | 10 | 300 | 0.54 | 400 | −0.39 | 500 |
| 26 | 10 | 875 | 300 | 1 | 270 | 0.67 | 400 | −0.39 | 600 |
| 27 | 10 | 850 | 250 | 7 | 375 | −0.05 | 475 | −2.16 | 600 |
| 28 | 10 | 850 | 300 | 4 | 80 | 0.96 | 380 | −0.11 | 600 |
| 29 | 10 | 840 | 300 | 6 | 300 | 0.54 | 550 | −6.22 | 600 |
| 30 | 10 | 840 | 300 | 7 | 300 | 0.54 | 300 | 0.54 | 500 |
| 31 | 5 | 850 | 250 | 8 | 275 | 0.65 | 400 | −0.39 | 10 |
| 32 | 10 | 875 | 300 | 6 | 300 | 0.68 | 420 | −0.19 | 300 |
| 33 | 10 | 850 | 300 | 8 | 300 | 0.50 | 420 | −0.85 | 500 |
| 34 | 10 | 850 | 300 | 4 | 300 | 0.65 | 420 | −0.30 | 500 |
| 35 | 10 | 850 | 250 | 6 | 300 | 0.42 | 420 | −1.17 | 300 |

Underlined portion: indicates a value out of the range according to the present invention A*: 1 − exp{−0.011 × (561 − [C] × 474 − [Mn] × 33 − [Ni] × 17 − [Cr] × 17 − [Mo] × 21 − Ta)}

B**: 1 − exp{−0.011 × (561 − [C] × 474 − [Mn] × 33 − [Ni] × 17 − [Cr] × 17 − [Mo] × 21 − Tb)}

TABLE 3

| Sample No. | Steel Sheet Microstructure: Ferrite Volume Fraction (%) | Ferrite Average Grain Diameter (μm) | Retained Austenite Volume Fraction (%) | Martensite Volume Fraction (%) | Martensite Average Grain Diameter (μm) | Remainder Kind*** | Average Number of Cementite Grains Having a Grain Diameter of 0.1 μm or More (piece/100 μm²) | Tensile Property: YS (MPa) | TS (MPa) | EL (%) | YR (%) | Hole Expansion Ratio λ (%) | Note |
|---|---|---|---|---|---|---|---|---|---|---|---|---|---|
| 1 | 1 | 2 | 12 | 8 | 3 | B, TM | 53 | 1005 | 1205 | 18.3 | 83 | 38 | Example |
| 2 | 2 | 1 | 13 | 7 | 4 | B, TM | 61 | 1056 | 1237 | 17.3 | 85 | 49 | Example |
| 3 | 1 | 1 | 14 | 9 | 3 | B, TM | 46 | 1004 | 1222 | 18.9 | 82 | 35 | Example |
| 4 | 0 | — | 11 | 7 | 3 | B, TM | 48 | 942 | 1230 | 18.6 | 77 | 36 | Example |
| 5 | 1 | 2 | 12 | 7 | 3 | B, TM | 55 | 1012 | 1219 | 17.6 | 83 | 41 | Example |
| 6 | 3 | 2 | 13 | 8 | 2 | B, TM | 49 | 1002 | 1211 | 17.8 | 83 | 39 | Example |
| 7 | 2 | 1 | 11 | 9 | 3 | B, TM | 48 | 1056 | 1251 | 17.1 | 84 | 38 | Example |
| 8 | 1 | 2 | 13 | 5 | 3 | B, TM | 51 | 1022 | 1264 | 17.5 | 81 | 44 | Example |
| 9 | 2 | 2 | 10 | 6 | 3 | B, TM | 46 | 983 | 1221 | 17.4 | 81 | 35 | Example |
| 10 | 2 | 2 | 11 | 7 | 3 | B, TM | 47 | 972 | 1233 | 17.6 | 79 | 40 | Example |
| 11 | 1 | 2 | 12 | 6 | 3 | B, TM | 48 | 969 | 1215 | 17.2 | 80 | 38 | Example |
| 12 | 2 | 2 | 12 | 8 | 4 | B, TM | 46 | 988 | 1215 | 17.3 | 81 | 39 | Example |
| 13 | 1 | 2 | 11 | 9 | 3 | B, TM | 46 | 999 | 1213 | 17.9 | 82 | 38 | Example |
| 14 | 3 | 4 | 8 | 7 | 5 | B, TM | 40 | 981 | 1211 | 14.3 | 81 | 25 | Comparative Example |

TABLE 3-continued

| | Steel Sheet Microstructure | | | | | | | | | | | | |
|---|---|---|---|---|---|---|---|---|---|---|---|---|---|
| | Ferrite | | Retained | Martensite | | | Average Number of Cementite Grains Having a Grain Diameter of | Tensile Property | | | | Hole Expansion Ratio | |
| Sample No. | Volume Fraction (%) | Average Grain Diameter (μm) | Austenite Volume Fraction (%) | Volume Fraction (%) | Average Grain Diameter (μm) | Remainder Kind*** | 0.1 μm or More (piece/100 μm$^2$) | YS (MPa) | TS (MPa) | EL (%) | YR (%) | λ (%) | Note |
| 15 | 2 | 4 | 8 | 9 | 5 | B, TM | 49 | 1012 | 1225 | 14.9 | 83 | 22 | Comparative Example |
| 16 | 1 | 2 | 11 | 8 | 5 | B, TM | 51 | 922 | 1198 | 17.3 | 77 | 23 | Comparative Example |
| 17 | 2 | 2 | 12 | 6 | 5 | B, TM | 46 | 953 | 1221 | 17.1 | 78 | 19 | Comparative Example |
| 18 | 1 | 3 | 10 | 12 | 5 | B, TM | 28 | 932 | 1189 | 17.9 | 78 | 22 | Comparative Example |
| 19 | 3 | 2 | 11 | 7 | 6 | B, TM | 35 | 982 | 1221 | 18.1 | 80 | 17 | Comparative Example |
| 20 | 1 | 2 | 9 | 8 | 3 | B, TM | 15 | 956 | 1211 | 16.3 | 79 | 20 | Comparative Example |
| 21 | 1 | 2 | 10 | 13 | 7 | B, TM | 12 | 892 | 1295 | 14.5 | 69 | 15 | Comparative Example |
| 22 | 3 | 2 | 10 | 7 | 5 | B, TM | 28 | 945 | 1211 | 16.1 | 78 | 21 | Comparative Example |
| 23 | 2 | 5 | 12 | 8 | 6 | B, TM | 33 | 890 | 1182 | 17.0 | 75 | 12 | Comparative Example |
| 24 | 8 | 4 | 10 | 9 | 3 | B, TM | 45 | 901 | 1201 | 17.5 | 75 | 13 | Comparative Example |
| 25 | 20 | 6 | 5 | 5 | 3 | B, TM | 20 | 768 | 991 | 16.4 | 77 | 5 | Comparative Example |
| 26 | 7 | 5 | 10 | 7 | 4 | B, TM, P | 44 | 856 | 1131 | 17.8 | 76 | 12 | Comparative Example |
| 27 | 1 | 2 | 15 | 22 | 6 | B, TM | 5 | 891 | 1241 | 17.3 | 72 | 11 | Comparative Example |
| 28 | 4 | 2 | 6 | 5 | 4 | B, TM | 88 | 901 | 1199 | 14.3 | 75 | 51 | Comparative Example |
| 29 | 2 | 2 | 8 | 8 | 4 | B, TM, P | 65 | 932 | 1221 | 15.5 | 76 | 33 | Comparative Example |
| 30 | 1 | 2 | 13 | 14 | 5 | B, TM | 16 | 944 | 1231 | 17.3 | 77 | 13 | Comparative Example |
| 31 | 1 | 2 | 11 | 12 | 4 | B, TM | 5 | 958 | 1256 | 17.1 | 76 | 12 | Comparative Example |
| 32 | 7 | 4 | 12 | 9 | 4 | B, TM | 38 | 923 | 1225 | 17.9 | 75 | 25 | Comparative Example |
| 33 | 1 | 2 | 8 | 12 | 4 | B, TM | 41 | 922 | 1210 | 16.2 | 76 | 31 | Comparative Example |
| 34 | 1 | 5 | 11 | 9 | 6 | B, TM | 61 | 888 | 1126 | 17.5 | 79 | 25 | Comparative Example |
| 35 | 1 | 2 | 16 | 21 | 6 | B, TM | 22 | 878 | 1321 | 11.3 | 66 | 16 | Comparative Example |

Underlined portion: indicates a value out of the range according to the present invention
Remainder***: B-bainite, TM-tempered martensite, and P-pearlite

The invention claimed is:

1. A high-strength cold-rolled steel sheet having a chemical composition comprising: by mass %, C: 0.15% or more and 0.30% or less, Si: 0.8% or more and 2.4% or less, Mn: 2.4% or more and 3.5% or less, P: 0.08% or less, S: 0.005% or less, Al: 0.01% or more and 0.08% or less, N: 0.010% or less, Ti: 0.002% or more and 0.05% or less, B: 0.0002% or more and 0.0050% or less, and the balance being Fe and inevitable impurities, a microstructure including ferrite having an average grain diameter of 3 μm or less and a volume fraction of 5% or less (including 0%), retained austenite having a volume fraction of 10% or more and 20% or less, martensite having an average grain diameter of 4 μm or less and a volume fraction of 20% or less (including 0%), and the balance including bainite and/or tempered martensite, wherein an average number of cementite grains having a grain diameter of 0.1 μm or more per 100 firm in a cross section in the thickness direction parallel to the rolling direction of the steel sheet is 30 or more.

2. The high-strength cold-rolled steel sheet according to claim 1, the steel sheet having the chemical composition further comprising: at least one of the following groups A to C, A: by mass %, one or more selected from V: 0.10% or less and Nb: 0.10% or less;

B: by mass %, one or more selected from Cr: 0.50% or less, Mo: 0.50% car less, Cu: 0.50% or less, and Ni: 0.50% or less; and C: by mass %, Ca and/or REM in an amount of 0.0050% or less in total.

3. A method for manufacturing a high-strength cold-rolled steel sheet, the method comprising:

performing hot rolling on a steel slab with a hot rolling start temperature of 1150° C. or higher and 1300° C. or lower and a finishing delivery temperature of 850° C. or higher and 950° C. or lower;

starting cooling within one second after hot rolling has been, performed;

performing first cooling to a temperature of 650° C. or lower at a first average cooling rate of 80° C./s or more;

subsequently performing second cooling to a temperature of 550° C. or lower at a second average cooling rate of 5° C./s or more, then coiling the cooled steel sheet at a coiling temperature of 550° C. or lower;

then performing a first heat treatment in which the coiled steel sheet is held in a temperature range of 400° C. or higher and 750° C. or lower for 30 seconds or more;

subsequently performing cold rolling; and performing continuous annealing as a second heat treatment, in which the cold-roiled steel sheet is heated to a temperature range of 830° C. or higher at an average heating rate of 3° C./s or more and 30° C./s or less, in which the heated steel sheet is held at a first soaking temperature of 830° C. or higher for 30 seconds or more, in which the held steel sheet is then cooled from the first soaking temperature to a cooling stop temperature range expressed by Ta° C., which satisfies relational expression (1) below, at an average cooling rate of 3° C./s or more, in which the cooled steel sheet is subsequently heated to a temperature range expressed by Tb° C., which satisfies relational expression (2) below, in which the heated steel sheet is held at a second soaking temperature in a temperature range expressed by Tb° C., which satisfies relational expression (2) below, for 20 seconds or more, and in which the held steel sheet is then cooled to room temperature to produce the high-strength cold-rolled steel sheet of claim 1:

$$0.35 \leq 1-\exp\{-0.011\times(561-[C]\times474-[Mn]\times33-[Ni]\times17-[Cr]\times17-[Mo]\times21-Ta)\} \leq 0.95, \quad \text{Relational expression (1):}$$

$$-3.0 \leq 1-\exp\{-0.011\times(561-[C]\times474-[Mn]\times33-[Ni]\times17-[Cr]\times17-[Mo]\times21-Tb)\} < 0.35, \quad \text{Relational expression (2):}$$

where, symbol [M] in each relational expression denotes the content (mass %) of the chemical element denoted by M.

4. A method for manufacturing a high-strength old-rolled steel sheet, the method comprising:

performing hot rolling on a steel slab with a hot rolling start temperature of 1150° C. or higher and 1300° C. or lower and a finishing delivery temperature of 850° C. or higher and 950° C. or lower;

starting cooling within one second after hot rolling has been performed;

performing first cooling to a temperature of 650° C. or lower at a first average cooling rate of 80° C./s or more;

subsequently performing second cooling to a temperature of 550° C. or lower at a second average cooling rate of 5° C./s or more, then coiling the cooled steel sheet at a coiling temperature of 550° C. or lower;

then performing a first heat treatment in which the coiled steel sheet is held temperature range of 400° C. or higher and 750° C. or lower for 30 seconds or more;

subsequently performing cold rolling; and performing continuous annealing as a second heat treatment, in which the cold-rolled steel sheet is heated to a temperature range of 830° C. or higher at an average heating rate of 3° C./s or more and 30° C./s or less, in which the heated steel sheet is held at a first soaking temperature of 830° C. or higher for 30 seconds or more, in which the held steel sheet is then cooled from the first soaking temperature to a cooling stop temperature range expressed by Ta° C., which satisfies relational expression (1) below, at an average cooling rate of 3° C./s or more, in which the cooled steel sheet is subsequently heated to a temperature range expressed by Tb° C., which satisfies relational expression (2) below, in which the heated steel sheet is held at a second soaking temperature in a temperature range expressed by Tb° C., which satisfies relational expression (2) below, for 20 seconds or more, and in which the held steel sheet is then cooled to room temperature to produce the high-strength cold-rolled steel sheet of claim 2:

$$0.35 \leq 1-\exp\{-0.011\times(561-[C]\times474-[Mn]\times33-[Ni]\times17-[Cr]\times17-[Mo]\times21-Ta)\} \leq 0.95, \quad \text{Relational expression (1):}$$

$$-3.0 \leq 1-\exp\{-0.011\times(561-[C]\times474-[Mn]\times33-[Ni]\times17-[Cr]\times17-[Mo]\times21-Tb)\} < 0.35, \quad \text{Relational expression (2):}$$

where, symbol [M] in each relational expression notes the content (mass %) of the chemical element denoted by M.

* * * * *